US006272881B1

(12) United States Patent
Kuroyanagi et al.

(10) Patent No.: US 6,272,881 B1
(45) Date of Patent: Aug. 14, 2001

(54) REFRIGERANT EVAPORATOR AND MANUFACTURING METHOD FOR THE SAME

(75) Inventors: Isao Kuroyanagi, Anjo; Masamichi Makihara, Gamagori; Toshio Ohara; Sadayuki Kamiya, both of Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/283,790

(22) Filed: Apr. 1, 1999

(30) Foreign Application Priority Data

Apr. 3, 1998 (JP) ..... 10-091833

(51) Int. Cl.[7] ..... F25B 39/02
(52) U.S. Cl. ..... 62/525; 165/153; 165/174
(58) Field of Search ..... 62/515, 524, 525; 165/153, 174

(56) References Cited

U.S. PATENT DOCUMENTS

| | | | | |
|---|---|---|---|---|
| 2,237,239 | * | 4/1941 | Smith | 62/525 |
| 5,662,164 | * | 9/1997 | Nishishita | 165/153 |
| 5,701,760 | | 12/1997 | Torigoe et al. | 62/524 |
| 5,735,343 | * | 4/1998 | Kajikawa et al. | 165/153 |
| 5,918,664 | * | 7/1999 | Torigoe | 165/153 |

FOREIGN PATENT DOCUMENTS

| | | |
|---|---|---|
| 0 632 245 A1 | 1/1995 | (EP) . |
| 0 683 373 A1 | 11/1995 | (EP) . |
| 0 802 383 A2 | 10/1997 | (EP) . |
| 0 807 794 A1 | 11/1997 | (EP) . |
| Y2-3-28276 | 6/1991 | (JP) . |
| U-7-12778 | 3/1995 | (JP) . |
| 10-19490 | 1/1998 | (JP) . |

* cited by examiner

*Primary Examiner*—Ronald Capossela
(74) *Attorney, Agent, or Firm*—Harness, Dickey & Pierce, PLC

(57) ABSTRACT

An evaporator has plural tubes arranged in parallel with each other in a width direction perpendicular to an air flowing direction. The tubes are further arranged in a plural rows in the air flowing direction, and tank portions extending in the width direction are arranged in the plural rows in the air flowing direction to correspond to the tubes. In the evaporator, refrigerant flows through a zigzag-routed refrigerant passage formed by the tank portions and the tubes. A partition wall defining adjacent two tank portions in the air flowing direction has plural bypass holes through which the adjacent two tank portions directly communicate with each other. Therefore, the zigzag-routed refrigerant passage of the evaporator is readily formed without an additional side passage or the like. Thus, the number of components of the evaporator is reduced thereby simplifying the structure of the evaporator, and pressure loss of refrigerant flowing in the evaporator is decreased.

13 Claims, 14 Drawing Sheets

REFRIGERANT EVAPORATOR AND MANUFACTURING METHOD FOR THE SAME

CROSS-REFERENCE TO RELATED APPLICATION

This application is related to and claims priority from Japanese Patent Application No. Hei. 10-91833 filed on Apr. 3, 1998, the contents of which are hereby incorporated by reference.

BACKGROUND OF THE INVENTION

1. Field of the Invention

The present invention relates to an evaporator for evaporating refrigerant of a refrigerant cycle and a method for manufacturing the evaporator. The evaporator is suitable for a vehicle air conditioner.

2. Related Art

U.S. Pat. No. 5,701,760 discloses a refrigerant evaporator by the applicant of the present invention. As shown in FIG. 20, an evaporator 100 has an upper inlet-side tank 50, a lower inlet-side tank 51, an upper outlet-side tank 52 and a lower outlet-side tank 53. The upper inlet-side tank 50 and the upper outlet-side tank 52 are disposed at an upper end of the evaporator 100, and the lower inlet-side tank 51 and the lower outlet-side tank 53 are disposed at a lower end of the evaporator 100. The evaporator 100 includes an inlet-side heat exchange portion X and an outlet-side heat exchange portion Y. The inlet-side heat exchange portion X is disposed on a downstream air side of the outlet-side heat exchange portion Y with respect to an air flowing direction A.

Further, the evaporator 100 has plural tubes through which refrigerant flows. Each of the tubes is formed by connecting a pair of metal thin plate having a bowl-like protruding portion at both longitudinal ends thereof. Each of the bowl-like protruding portions is integrally connected with each other, thereby forming the tanks 50–53.

As shown in FIG. 20, refrigerant is introduced into the evaporator 100 from an inlet 54*a* formed in a pipe joint 54 and flows into a first inlet-side tank portion 51*a* of the lower inlet-side tank 51 through a side passage 55. Then, refrigerant flows upwardly through a downstream-air-side passage I of the tubes and flows into the upper inlet-side tank 50. Refrigerant in the upper inlet-side tank 50 flows downwardly through a downstream-air-side passage II of the tubes and flows into a second inlet-side tank portion 51*b* of the lower inlet-side tank 51. Next, refrigerant flows from the second inlet-side tank portion 51*b* into a first outlet-side tank portion 52*a* of the upper outlet-side tank 52 through a side passage 56. Then, refrigerant flows downwardly through an upstream-air-side passage III of the tubes and flows into the lower outlet-side tank 53. Refrigerant in the lower outlet-side tank 53 flows upwardly through an upstream-air-side passage IV of the tubes and flows into a second outlet-side tank portion 52*b* of the upper outlet-side tank 52. Finally, refrigerant flows through a side passage 57 and is discharged to the outside of the evaporator 100 through an outlet 54*b*.

In the evaporator 100, the inlet-side heat exchange portion X is disposed on the downstream air side of the outlet-side heat exchange portion Y, and a flowing direction of refrigerant in the inlet-side heat exchange portion X corresponds to that in the outlet-side heat exchange portion Y. That is, in FIG. 20, refrigerant flows upwardly on a right side of partition members 58, 59 and flows downwardly on a left side of the partition members 58, 59 in both of the heat exchange portions X, Y. Therefore, even when liquid-gas two-phase refrigerant is biasedly distributed into the passages I–IV, air having an uniform temperature distribution is blown out from the evaporator 100. Further, refrigerant flows in a zigzag route through the passages I, II in the inlet-side heat exchange portion X and through the passages III, IV in the outlet-side heat exchange portion Y. As a result, heat amount absorbed by refrigerant is increased, thereby improving cooling performance of the evaporator 100.

However, the evaporator 100 requires the side passage 56 for a communication between the passage II and the passage III, and the side passages 55, 57 for a communication between the inlet 54*a* and the passage I and a communication between the passage IV and the outlet 54*b*. Each of the side passages 55–57 may be formed between two metal thin plates disposed on an end surface of the evaporator 100. As a result, the number of parts of the evaporator 100 is increased, thereby increasing production cost of the evaporator 100. Further, pressure loss of refrigerant in the evaporator 100 is increased due to the side passages 55–57. As a result, evaporation pressure and evaporation temperature of refrigerant in the evaporator 100 is increased, and cooling performance of the evaporator 100 is decreased.

SUMMARY OF THE INVENTION

In view of the foregoing problems, it is an object of the present invention to provide an evaporator having a zigzag-routed refrigerant passage formed by plural tanks and plural tubes arranged in plural rows, in which the number of parts is reduced thereby simplifying a structure, and pressure loss of refrigerant is reduced.

According to the present invention, an evaporator includes a plurality of tubes through which refrigerant flows and a tank disposed at both longitudinal ends of each tube for distributing refrigerant to the tubes and collecting refrigerant from the tubes. The tubes are arranged in parallel with each other in a width direction perpendicular to a flow direction of external fluid passing through the evaporator, and is further arranged in plural rows in the flow direction of the external fluid. The evaporator further has a partition wall for dividing the tank into plural tank portions extending in the width direction, and the tank portions are arranged in the plural rows in the flowing direction of the external fluid to correspond to the arrangement of the tubes. The partition wall has a bypass passage unit through which adjacent two tank portions communicate with each other in the flow direction of the external fluid. As a result, a zigzag-routed refrigerant passage of the evaporator is readily formed without using an additional side passage or the like. That is, the bypass passage unit is formed in the partition wall, a U-turn routed refrigerant passage is readily formed in the evaporator. Therefore, the number of parts of the evaporator is reduced, thereby simplifying the structure thereof and reducing production cost thereof. Further, pressure loss of refrigerant in the evaporator is decreased, thereby improving cooling performance of the evaporator.

Preferably, the bypass passage unit is plural holes arranged in the width direction perpendicular both of the flow direction of the external fluid and a flow direction of refrigerant in each tube. Therefore, the U-turn routed refrigerant passage is readily simply formed in the evaporator without a side passage for U-turning the refrigerant flow.

More preferably, the tubes and the tank portions are separately formed and thereafter integrally connected with each other. Therefore, a thickness of each tube can be decreased so that a size of the evaporator is reduced and minuteness of a heat exchange portion of the evaporator is improved, while a thickness of each of the tank portions can be increased so that each of the tank portions has sufficient strength. Further, the tank portions and the partition wall having the holes are formed from a single thin metal plate by bending the single thin metal plate. Therefore, the producing cost of the evaporator can be further reduced.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Preferred embodiments of the present invention are described hereinafter with reference to the accompanying drawings.

Figure 1:
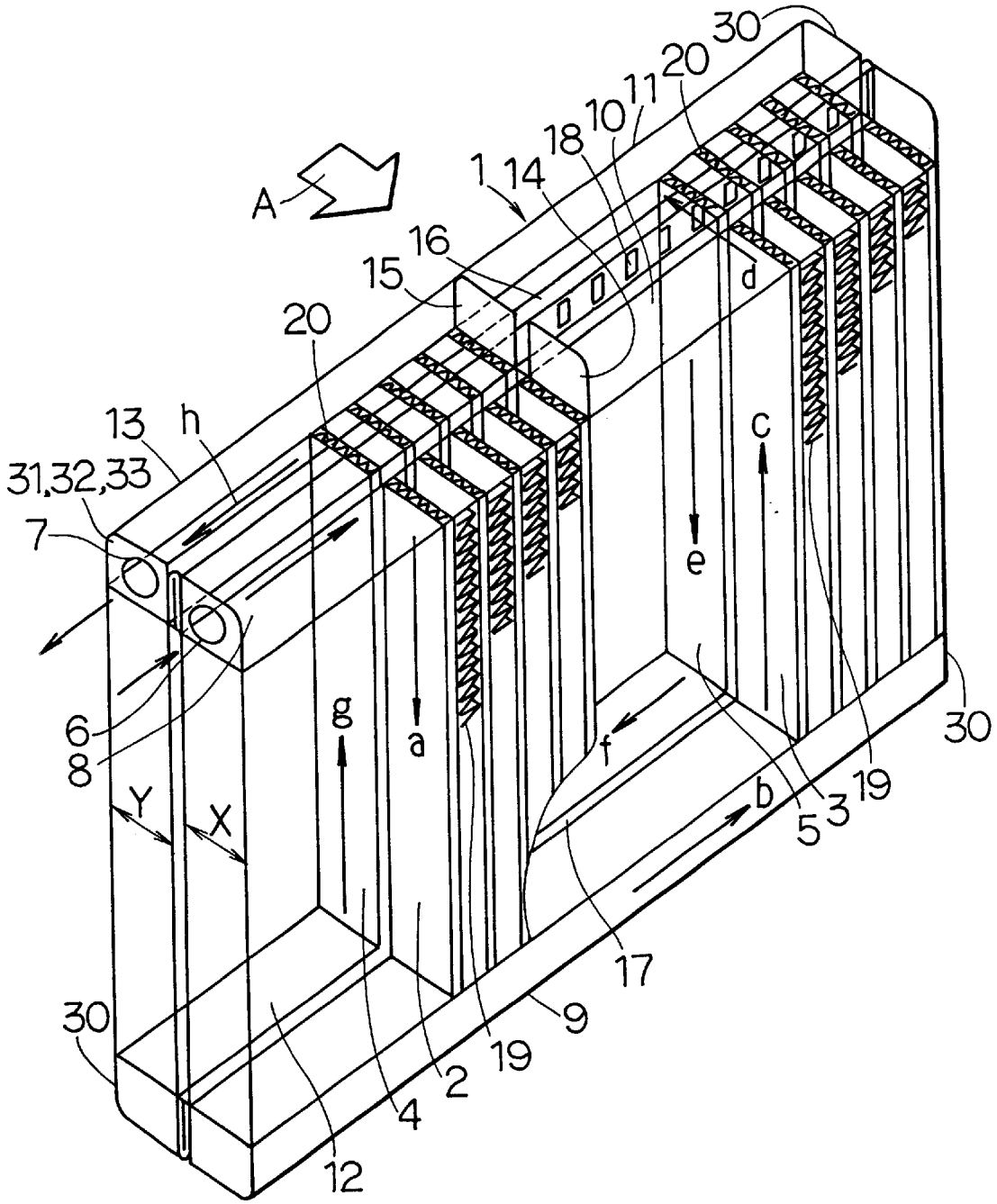
FIG. 1 is a schematic perspective view showing an evaporator according to a first preferred embodiment of the present invention.

A first preferred embodiment of the present invention will be described with reference to FIGS. 1–14D. In the first embodiment, the present invention is typically applied to an evaporator 1 of a refrigerant cycle for a vehicle air conditioner. As shown in FIG. 1, the evaporator 1 is disposed in a unit case of a vehicle air conditioner (not shown) in an up-down direction shown in FIG. 1. When air is blown by a blower (not shown) and passes through the evaporator 1 in an air flowing direction A in FIG. 1, heat exchange is performed between blown-air and refrigerant flowing through the evaporator 1.

The evaporator 1 has plural tubes 2–5 through which refrigerant flows in a longitudinal direction of the tubes 2–5. The tubes 2–5 are arranged in parallel with each other in a width direction perpendicular to both of the air flowing direction A and the longitudinal direction of the tubes 2–5. Further, the tubes 2–5 are arranged in two rows disposed adjacent to each other in the air flowing direction A. That is, the tubes 2, 3 are arranged at a downstream air side, and the tubes 4, 5 are arranged at an upstream air side of the tubes 2, 3. Each of the tubes 2–5 is a flat tube forming a refrigerant passage with a flat cross-section therein. The tubes 2, 3 form a refrigerant passage of an inlet-side heat exchange portion X, and the tubes 4, 5 form a refrigerant passage of an outlet-side heat exchange portion Y. In FIG. 1, the tubes 2 are disposed at a left side of the inlet-side heat exchange portion X, and the tubes 3 are disposed at a right side of the inlet-side heat exchange portion X. Similarly, the tubes 4 are disposed at a left side of the outlet-side heat exchange portion Y, and the tubes 5 are disposed at a right side of the outlet-side heat exchange portion Y.

The evaporator 1 has an inlet 6 for introducing refrigerant and an outlet 7 for discharging refrigerant. Low-temperature and low-pressure gas-liquid two-phase refrigerant decompressed by a thermal expansion valve (not shown) of the refrigerant cycle is introduced into the evaporator 1 through the inlet 6. The outlet 7 is connected to an inlet pipe of a compressor (not shown) of the refrigerant cycle so that gas refrigerant evaporated in the evaporator 1 is returned to the compressor through the outlet 7. In the first embodiment, the inlet 6 and the outlet 7 are disposed on an upper left end surface of the evaporator 1.

The evaporator 1 has an upper left inlet-side tank portion 8 disposed at an upper left inlet side, a lower inlet-side tank portion 9 disposed at a lower inlet side, an upper right inlet-side tank portion 10 disposed at an upper right inlet side, an upper right outlet-side tank portion 11 disposed in an upper right outlet side of the evaporator 1, a lower outlet-side tank portion 12 disposed at a lower outlet-side, and an upper left outlet-side tank portion 13 disposed at an upper left outlet side. The inlet 6 communicates with the upper left inlet-side tank portion 8, and the outlet 7 communicates with the upper left outlet-side tank portion 13. Refrigerant is distributed from the tank portions 8–13 into each of the tubes 2–5 and is collected from each of the tubes 2–5 into the tank portions 8–13. The tank portions 8–13 are also arranged in two rows adjacent to each other in the air flowing direction A, corresponding to the tubes 2–5. That is, the inlet-side tank portions 8–10 are disposed on the downstream air side of the outlet-side tank portions 11–13.

The upper inlet-side tank portions 8, 10 are defined by a partition plate 14 disposed therebetween, and the upper outlet-side tank portions 11, 13 are defined by a partition plate 15 disposed therebetween. The lower inlet-side tank portion 9 and the lower outlet-side tank portion 12 are not partitioned, and extend along an entire width of the evaporator 1 in the width direction.

In the inlet-side heat exchange portion X of the evaporator 1, each upper end of the tubes 2 communicates with the upper left inlet-side tank portion 8, and each lower end of the tubes 2 communicates with the lower inlet-side tank portion 9. Similarly, each upper end of the tubes 3 communicates with the upper right inlet-side tank portion 10, and each lower end of the tubes 3 communicates with the lower inlet-side tank portion 9. In the outlet-side heat exchange portion Y of the evaporator 1, each upper end of the tubes 4 communicates with the upper left outlet-side tank portion 13, and each lower end of the tubes 4 communicates with the lower outlet-side tank portion 12. Similarly, each upper end of the tubes 5 communicates with the upper right outlet-side tank portion 11 and each lower end of the tubes 5 communicates with the lower outlet-side tank portion 12.

A partition wall 16 is formed between the upper left inlet-side tank portion 8 and the upper left outlet-side tank portion 13, and between the upper right inlet-side tank portion 10 and the upper right outlet-side tank portion 11. That is, the partition wall 16 extend in the whole width of the evaporator 1 in the width direction. A partition wall 17 is also formed between the lower inlet-side tank portion 9 and the lower outlet-side tank portion 12 to extend in the whole width of the evaporator 1 in the width direction. The partition walls 16, 17 are integrally formed with the tank portions 8–13.

In the first embodiment of the present invention, a right-side portion of the partition wall 16 partitioning the tank portions 10, 11 in FIG. 1 has plural bypass holes 18 through which the tank portions 10, 11 communicate with each other. In the first embodiment, the bypass holes 18 are formed to respectively correspond to the tubes 3, 5, so that refrigerant is uniformly distributed into the tubes 3, 5. That is, the number of the bypass holes 18 is the same as the number of each of the tubes 3, 5.

The bypass holes 18 are simultaneously stamped on the partition wall 16 made of a metal thin plate (e.g., aluminum thin plate) through pressing or the like. In the first embodiment, each of the bypass holes 18 is formed into a rectangular shape. Opening areas of the bypass holes 18 and arrangement positions of the bypass holes 18 are determined so that most appropriate distribution of refrigerant flowing into the tubes 3, 5 is obtained. In FIG. 1, the bypass holes 18 are formed to have an uniform area. Therefore, the bypass holes 18 are readily formed. However, the opening areas of the bypass holes 18 and the shapes thereof may be arbitrarily changed.

Plural wave-shaped corrugated fins 19 are disposed between adjacent tubes 2–5, and are integrally connected to flat surfaces of the tubes 2–5. Further, plural wave-shaped inner fins 20 are disposed inside each of the tubes 2–5. Each wave peak portion of the inner fins 20 is bonded to each inner surface of the tubes 2–5. Due to the inner fins 20, the tubes 2–5 are reinforced and a heat conduction area for refrigerant is increased, thereby improving cooling performance of the evaporator 1. The tubes 2–5, the corrugated fins 19 and the inner fins 20 are integrally brazed to form the heat exchange portions X, Y of the evaporator 1. In the first embodiment, the evaporator 1 is assembled by integrally connecting each of the parts through brazing.

Next, operation of the evaporator 1 according to the first embodiment of the present invention will be described. As shown in FIG. 1, first, low-temperature and low-pressure gas-liquid two-phased refrigerant decompressed by the expansion valve (not shown) of the refrigerant cycle is introduced into the upper left inlet-side tank portion 8 from the inlet 6, and is distributed into the tubes 2 to flow downwardly through the tubes 2 as shown by arrow "a". Then, refrigerant flows through the lower inlet-side tank portion 9 rightwardly as shown by arrow "b", and is distributed into the tubes 3 to flow upwardly through the tubes 3 as shown by arrow "c". Refrigerant flows into the upper right inlet-side tank portion 10, passes through the bypass holes 18 as shown by arrow "d", and flow into the upper right outlet-side tank portion 11. Thus, refrigerant moves from the downstream air side to the upstream air side through the bypass holes 18. Thereafter, refrigerant is distributed into the tubes 5 from the upper right outlet-side tank portion 11, flows downwardly through the tubes 5 as shown by arrow "e", and flows into a right-side portion of the lower outlet-side tank portion 12.

Further, refrigerant flows leftwardly as shown by arrow "f" through the lower outlet-side tank portion 12, is distributed into the tubes 4, and flow upwardly through the tubes 4 as shown by arrow "g". Thereafter, refrigerant is collected into the upper left outlet-side tank portion 13, flows leftwardly as shown by arrow "h" through the tank portion 13, and is discharged from the outlet 7 to the outside of the evaporator 1.

On the other hand, air is blown in direction A toward the evaporator 1 and passes through openings of the heat exchange portions X, Y of the evaporator 1. At this time, refrigerant flowing through the tubes 2–5 absorbs heat from air and is evaporated. As a result, air is cooled, and is blown into a passenger compartment of the vehicle to cool the passenger compartment.

According to the first embodiment, the inlet-side heat exchange portion x including a zigzag-routed inlet-side refrigerant passage indicated by arrows "a"–"c" in FIG. 1 is disposed on the downstream air side of the outlet-side heat exchange portion Y including a zigzag-routed outlet-side refrigerant passage indicated by arrows "e"–"h" in FIG. 1. Therefore, the evaporator 1 can effectively perform heat exchange with excellent heat conductivity.

Further, the upper right inlet-side tank portion 10 and the upper right outlet-side tank portion 11 disposed on the upstream air side of the tank portion 10 directly communicate with each other through the bypass holes 18 formed in the partition wall 16 disposed therebetween. Therefore, the inlet-side refrigerant passage of the evaporator 1 communicates with the outlet-side refrigerant passage of the evaporator 1 without any additional refrigerant passage such as a side passage. Thus, a structure of the evaporator 1 is simplified and pressure loss of refrigerant flowing through the evaporator 1 is decreased. As a result, evaporation pressure and evaporation temperature of refrigerant in the evaporator 1 is decreased, thereby improving cooling performance of the evaporator 1.

Further, refrigerant can be uniformly distributed into the tubes 3, 5 by appropriately setting each opening area of the bypass holes 18 and arrangement positions of the bypass holes 18. As a result, refrigerant is evaporated uniformly in the whole heat-exchange area of the evaporator 1 including the tubes 3, 5, thereby further improving cooling performance of the evaporator 1.

Next, the structure of the evaporator 1 and a manufacturing method thereof according to the first embodiment will be described with reference to FIGS. 2–14D.

Figure 2:
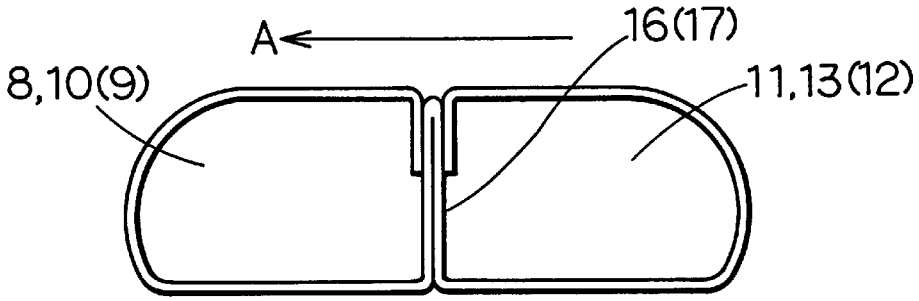
FIG. 2 is a schematic sectional view showing an end surface of tank portions of the evaporator according to the first embodiment.

As shown in FIG. 2, the upper tank portions 8, 10, 11, 13 or the lower tank portions 9, 12 is formed by bending an aluminum thin plate. That is, the upper tank portions 8, 10, 11, 13 and partition wall 16 are integrally formed by bending a single aluminum thin plate. A center folded portion of the aluminum thin plate forms the partition wall 16. Similarly, the lower tank portions 9, 12 and the partition wall 17 are integrally formed by bending a single aluminum thin plate. The tank portions 8–13 are applied with relatively large stress by refrigerant pressure in comparison with the tubes 2–5. Therefore, for example, a thickness of the aluminum thin plate for forming the tank portions 8–13 is 0.6 mm so that the tank portions 8–13 have sufficient strength.

Each aluminum thin plate for forming the tank portions 8–13 is a one-side clad aluminum plate, i.e., an aluminum core plate (A3000) clad with brazing material (A4000) on only one side surface thereof, for example. The one-side clad aluminum plate is disposed so that the surface clad with brazing material is disposed inside the tank portions 8–13 and the core plate is exposed outside. Sacrifice corrosion material (e.g., Al-1.5 wt % Zn) may be applied to an outer surface of the core plate so that the core plate is sandwiched between brazing material and sacrifice corrosion material. As a result, anti-corrosion performance of the one-side clad aluminum plate is improved.

Figure 3A:
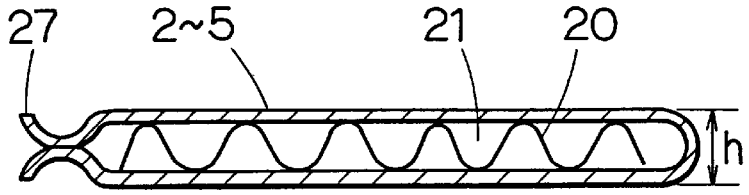
FIG. 3A is a schematic sectional view showing a tube of the evaporator according to the first embodiment.

Referring to FIG. 3A, a single aluminum thin plate is bent so that an inner refrigerant passage 21 having a flat-shaped cross section is formed in each of the tubes 2–5. The inner refrigerant passage 21 is partitioned into plural small passages by the inner fins 20. The inner surfaces of the tubes 2–5 and each of the wave peak portions of the inner fins 20 are bonded so that the plural small passages extending in the longitudinal direction of the tubes 2–5 are partitioned in the inner refrigerant passage 21.

Figure 3B:
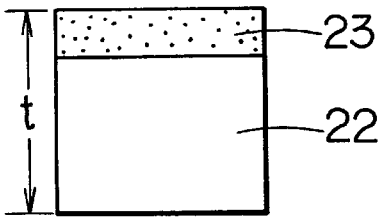
FIG. 3B is a view for explaining a tube forming material according to the first embodiment.

As shown in FIG. 3B, the aluminum thin plate for forming the tubes 2–5 may be an aluminum bare plate, i.e., an aluminum core plate 22 (A3000) applied with sacrifice corrosion material 23 (e.g., Al-1.5 wt % Zn) on one side surface thereof, for example. In this case, the aluminum bare plate is disposed so that the surface applied with the sacrifice corrosion material 23 is disposed outside the tubes 2–5. Since the tubes 2–5 are reinforced by the inner fins 20, thickness "t" of the aluminum thin plate for forming the tubes 2–5 can be decreased to approximately 0.25–0.4 mm. Therefore, a height "h" of each of the tubes 2–5 can be decreased to approximately 1.75 mm in the width direction. The inner fins 20 are also made of an aluminum bare plate (A3000).

Figure 3C:
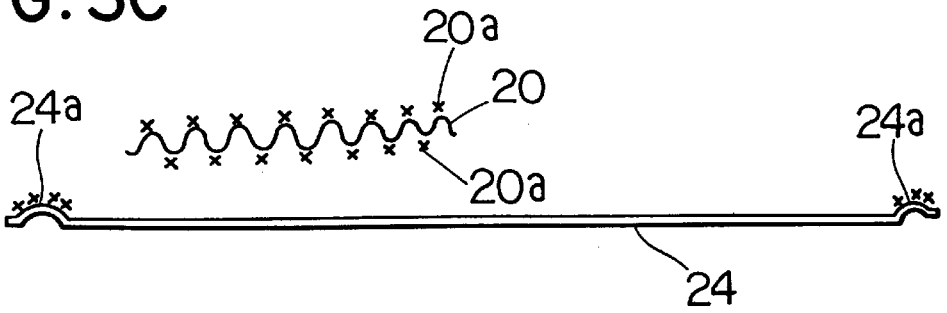
FIG. 3C is a view for explaining an applying state of brazing material onto a tube-forming member according to the first embodiment.

As shown in FIG. 3C, brazing material (A4000) is applied to connection points on the tubes 2–5 and the inner fins 20 for connection between each of the tubes 2–5 and the inner fins 20. That is, before bending an aluminum thin plate 24 for forming the tubes 2–5 (hereinafter referred to as tube thin plate 24), paste brazing material 24*a* (A4000) is applied to an inner surface of both lateral end portions of the tube thin plate 24. Similarly, before attaching the inner fin 20 to an inner surface of each of the tubes 2–5, paste brazing material 20*a* (A4000) is applied to each of the wave peak portions of the inner fin 20. Therefore, connection between the lateral end portions of the tube thin plate 24 and connection between the inner surface of the tube thin plate 24 and the inner fin 20 can be simultaneously performed when the evaporator 1 is integrally brazed. When the tube thin plate 24 is an one-side clad aluminum plate clad with brazing material on one side surface thereof to be disposed inside the tubes 2–5, brazing material does not need to be applied to the tube thin plate 24. Further, each of the inner fins 20 may be made of a both-side clad aluminum plate clad with brazing material on both side surfaces thereof. In this case, application of brazing material to the wave peak portions of the inner fin 20 is not needed.

Figure 4:
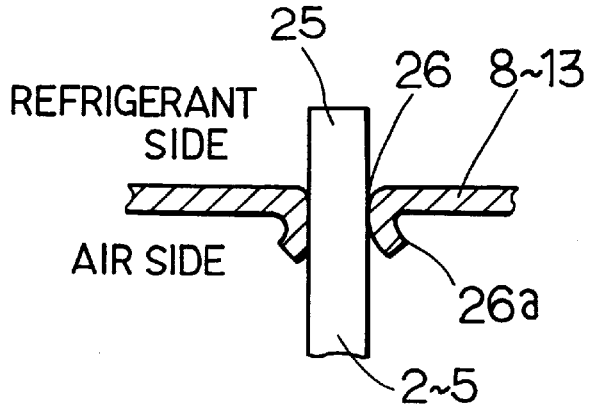
FIG. 4 is a cross-sectional view showing a connection structure between the tank portions and the tube of the evaporator according to the first embodiment.
Figure 5E:
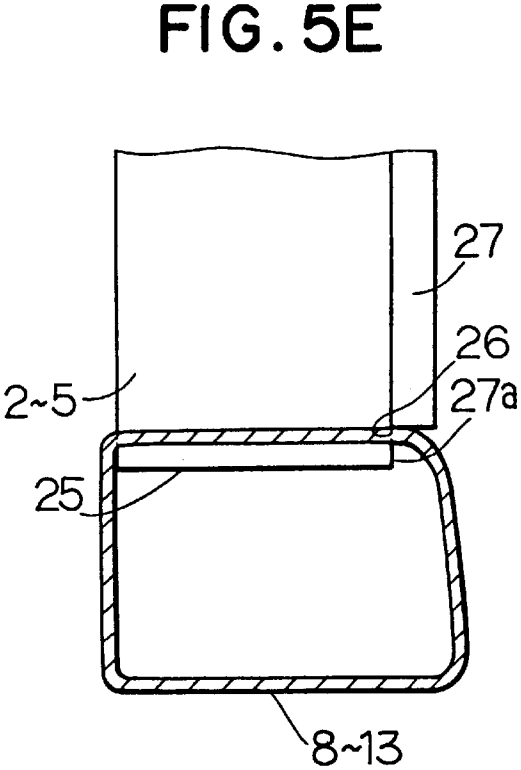
FIG. 5E is a schematic view showing a connection structure between the longitudinal end portion of the tube and the tank portion of the evaporator according to the first embodiment.
Figure 5C:
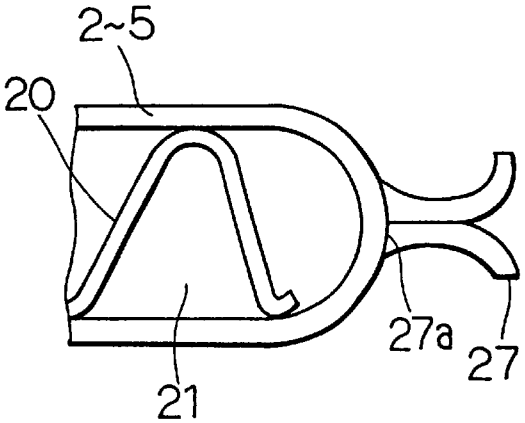
FIG. 5C is an enlarged partial view of FIG. 5B.
Figure 5D:
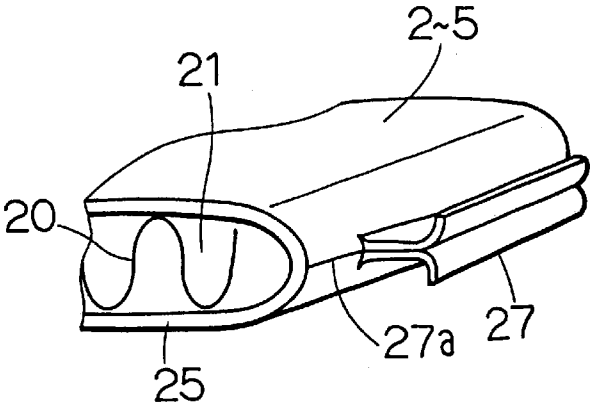
FIG. 5D is an enlarged perspective view showing the longitudinal end portion of the tube according to the first embodiment.
Figure 5A:
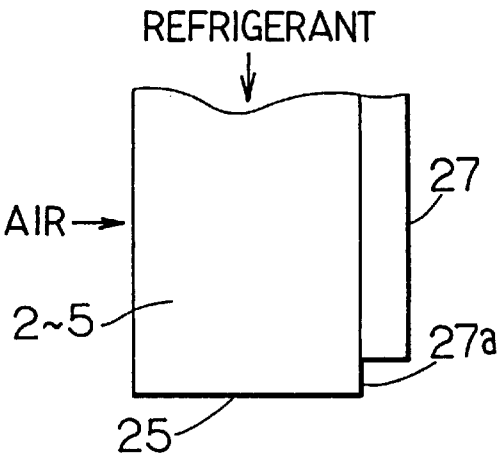
FIG. 5A is a flat view showing a longitudinal end portion of the tube of the evaporator according to the first embodiment.
Figure 5B:
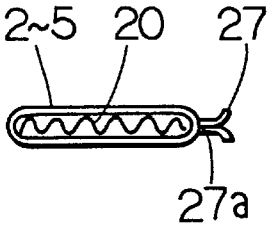
FIG. 5B is a front view showing the longitudinal end of the tube according to the first embodiment.

As shown in FIG. 4, in the first embodiment, each of end portions 25 of the tubes 2–5 in the longitudinal direction is connected to the tank portions 8–13 by inserting end portions 25 into tube insertion holes 26 formed in each flat surface of the tank portions 8–13. In order to facilitate insertion of the tubes 2–5 into the tank portions 8–13, each of the end portions 25 is formed as shown in FIG. 5A. That is, as shown in FIGS. 3A, 5A, each of the tubes 2–5 has an end enlarged portion 27 at which the lateral end portions of the tube thin plate 24 are connected with each other. As shown in FIG. 5A, the end enlarged portion 27 is cut off at both longitudinal ends of each of the tubes 2–5, thereby forming a recess portion 27*a*. That is, each end portion 25 of tubes 2–5 does not have the end enlarged portion 27. As a result, each of the longitudinal end portions 25 has a substantially oval cross-section. As shown in FIG. 5E, the recess portion 27*a* is used as a positioning stopper for each of the tubes 2–5 when the end portion 25 is inserted into the tube insertion hole 26. As a result, insertion of the tubes 2–5 into the tank portions 8–13 is facilitated. FIG. 5E shows only one of the downstream air side and the upstream air side of the tank portions 8–13 and the tubes 2–5 for brevity.

Each tube insertion hole 26 is formed into an oval shape corresponding to a cross-sectional shape of each end portion 25 of the tubes 2–5. Each of the tube insertion hole 26 has a projecting portion 26*a* formed to project outside the tank portions 8–13 along a circumference of the tube insertion hole 26. As shown in FIG. 4, when each of the end portions 25 of the tubes 2–5 is inserted into the tube insertion holes 26, inner surfaces of the projecting portions 26*a* of the tank portions 8–13 contacts each of the end portions 25. Therefore, the tank portions 8–13 and the tubes 2–5 can be connected with each other through brazing material applied on the inner surfaces of the tank portions 8–13.

Figure 6:
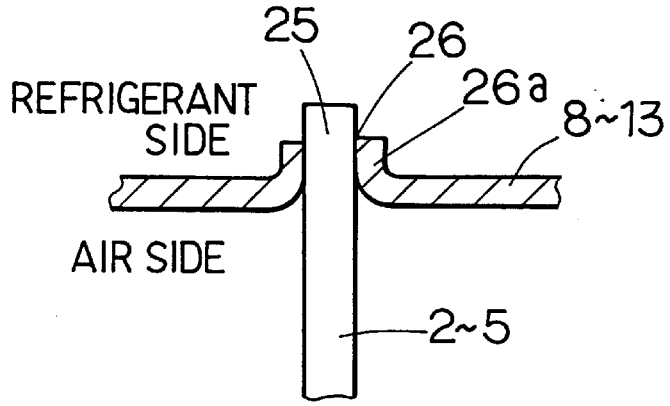
FIG. 6 is a cross-sectional view showing a connection structure between the tank portions and the tube of the evaporator according to a modification of the first embodiment.

As shown in FIG. 6, the projecting portions 26*a* may project inside the tank portions 8–13. In this case, brazing material may be applied to each of the end portions 25 of the tubes 2–5 before inserting the tubes 2–5 into the tank portions 8–13. Therefore, the tank portions 8–3 and the tubes 2–5 can be brazed with each other through brazing material applied onto each of the end portions 25.

Figure 7:
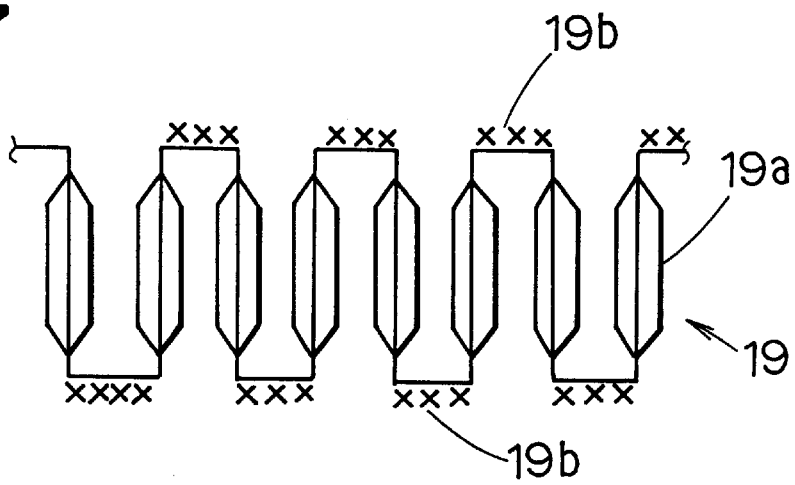
FIG. 7 is a view for explaining an applying state of brazing material onto corrugated fins of the evaporator according to the first embodiment.

As shown in FIG. 7, the corrugated fin 19 has well-known louvers 19*a* formed by cutting and standing slantingly. The corrugated fin 19 is made of an aluminum bare plate (A3000). Therefore, after brazing material 19*b* is applied to each of wave peak portions of the corrugated fin 19, the corrugated fin 19 is connected to the tubes 2–5 by the wave peak portions through the brazing material 19*b*.

Figure 8:
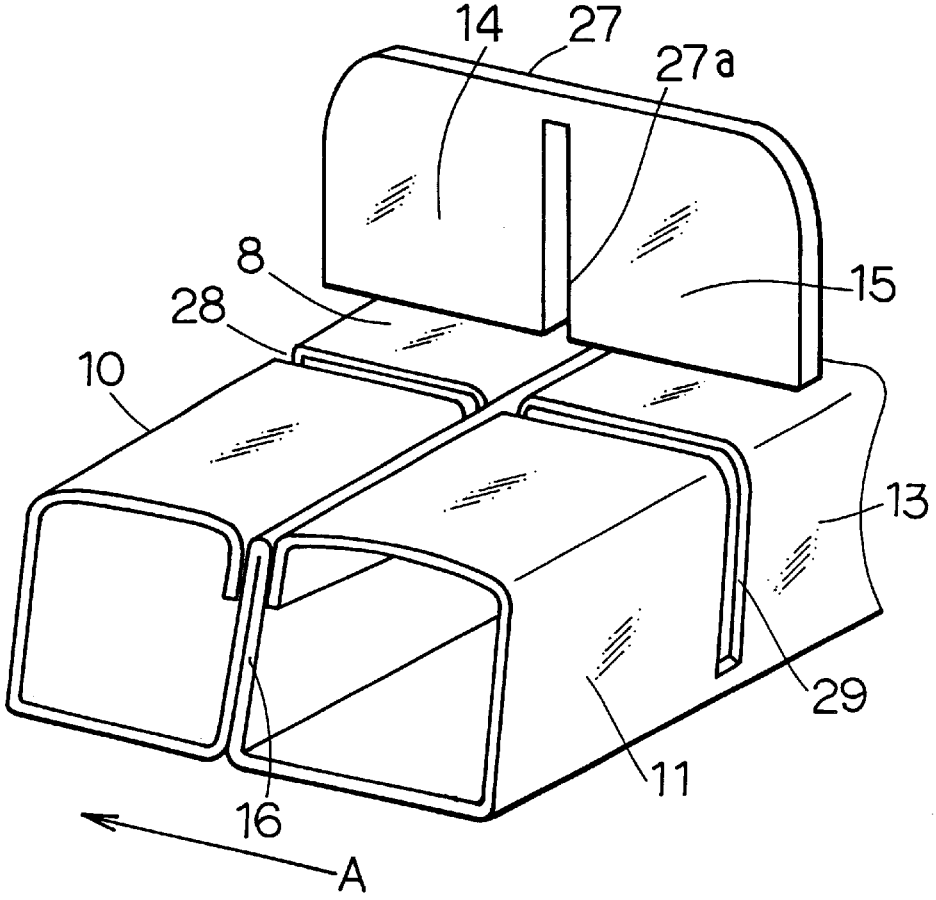
FIG. 8 is an enlarged perspective view showing a disassemble state of partition plates and the tank portions of the evaporator according to the first embodiment.

As shown in FIG. 8, the partition plates 14, 15 are integrally formed using a single plate member 27 so that attachment of the partition plates 14, 15 to the tank portions 8, 10, 11 and 13 is facilitated. The plate member 27 forming the partition plates 14, 15 is made of a both-side clad aluminum plate, i.e., an aluminum core plate (A3000) clad with brazing material (A4000) on both side surfaces thereof, for example.

The plate member 27 has a slit groove 27*a* engaged with the partition wall 16 disposed between the tank portion 8 and the tank portion 13 and between the tank portion 10 and the tank portion 11. A slit groove 28 into which the partition plate 14 is inserted is formed between the tank portion 8 and the tank portion 10, and a slit groove 29 into which the partition plate 15 is inserted is formed between the tank portion 11 and the tank portion 13. The partition plates 14, 15 are respectively inserted into the slit grooves 28, 29 while the slit groove 27*a* is engaged with the partition wall 16. Therefore, the partition plates 14, 15 are connected to the tank portions 8, 10, 11 and 13 using brazing material applied on the both side surfaces of the plate member 27 and brazing material applied on the inner surfaces of the tank portions 8, 10, 11 and 13. Thus, the tank portion 8 and the tank portion 10 are partitioned from each other, and the tank portion 11 and the tank portion 13 are partitioned from each other. The partition plates 14, 15 may be separately formed.

Figure 9:
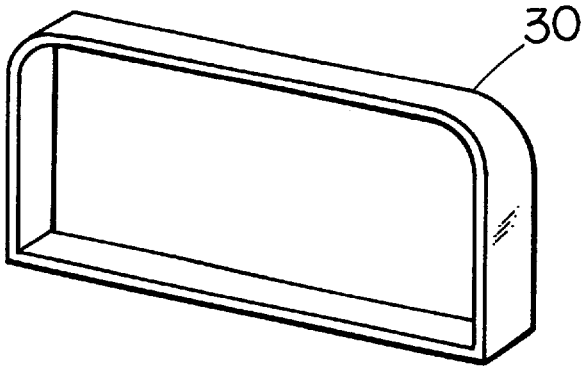
FIG. 9 is a perspective view showing a lid portion for the tank portions of the evaporator according to the first embodiment.

FIG. 9 shows a lid portion 30 for the tank portions 8–13. As shown in FIG. 1, the tank portions 8–13 have four longitudinal end openings, that is, upper-right end opening, upper-left end opening, lower-right end opening and lower-left end opening. The lid portion 30 is attached to each of the three end openings, except for the upper-left end opening at which the inlet 6 and outlet 7 are disposed. The lid portion 30 is formed into a bowl-like shape through pressing using an one-side clad aluminum plate clad with brazing material on one side surface thereof. The surface clad with brazing material is set to an inner surface of the lid portion 30. The inner surface of the lid portion 30 is engaged with and connected to an outer surface of each of the three longitudinal end portions of the tank portions 8–13 through brazing material applied on the inner surface of the lid portion 30. Thus, the three longitudinal end openings of the tank portions 8–13 except for the upper left end opening where the inlet 6 and the outlet 7 are formed, are closed.

Figure 10:
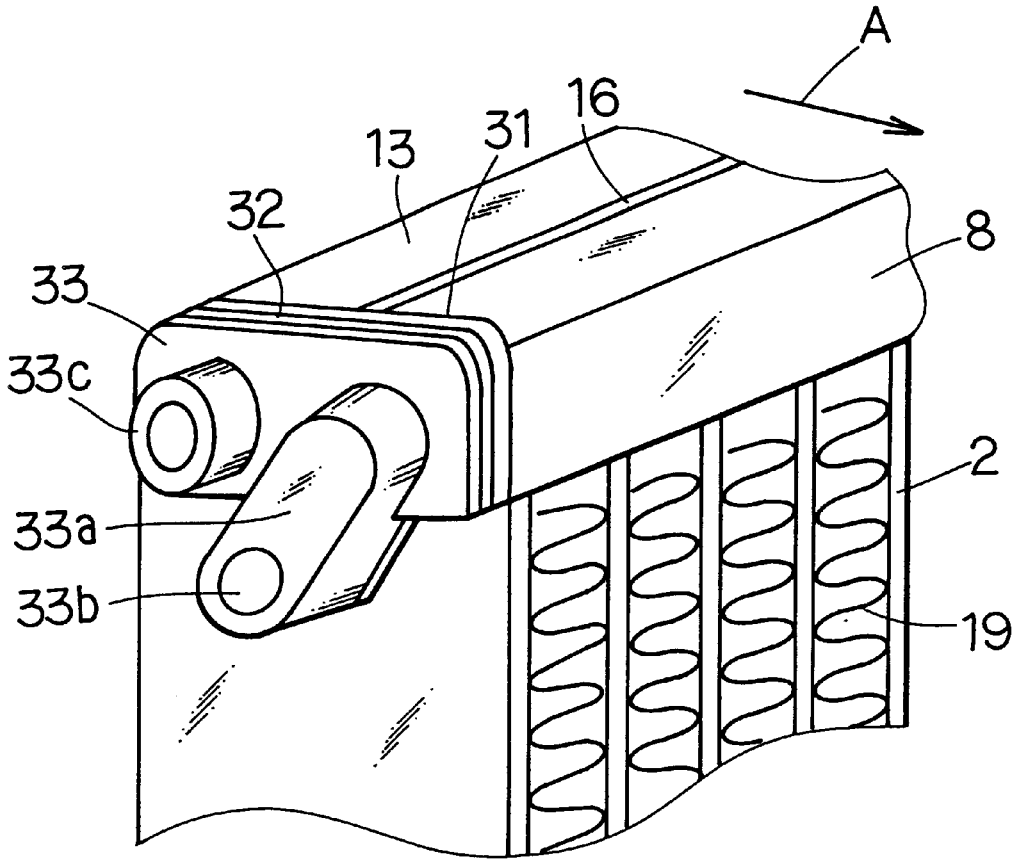
FIG. 10 is a perspective view showing a pipe joint portion of the evaporator according to the first embodiment.
Figure 11:
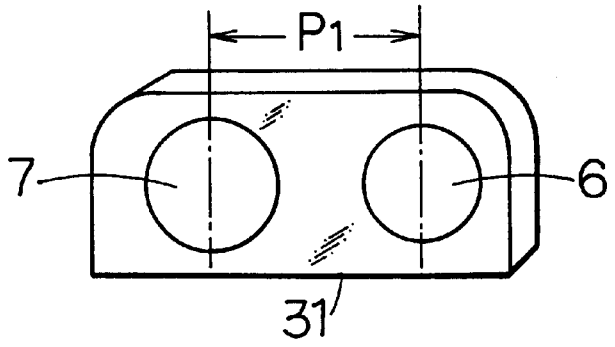
FIG. 11 is a perspective view showing a lid portion to which the pipe joint portion is attached according to the first embodiment.

Next, a pipe joint portion of the evaporator 1 will be described with reference to FIGS. 10–12C. The pipe joint portion is disposed at the upper-left end opening of the tank portions 8, 13. As shown in FIG. 10, the pipe joint portion includes a lid portion 31, an intermediate plate member 32 and a joint cover 33. As shown in FIG. 11, the lid portion 31 is formed through pressing using a both-side clad aluminum plate clad with brazing material on both side surfaces thereof, and is connected to the upper-left end portion of the tank portions 8, 13. The lid portion 31 includes the inlet 6 communicating with the tank portion 8 and the outlet 7 communicating with the tank portion 13.

Figure 12C:
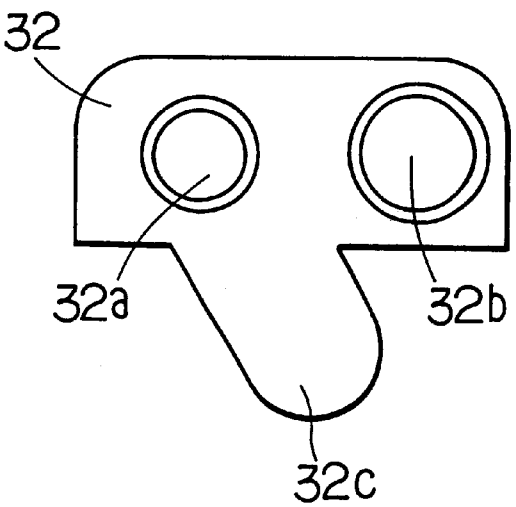
FIG. 12C is a front view showing an intermediate plate member of the pipe joint portion according to the first embodiment.
Figure 12B:
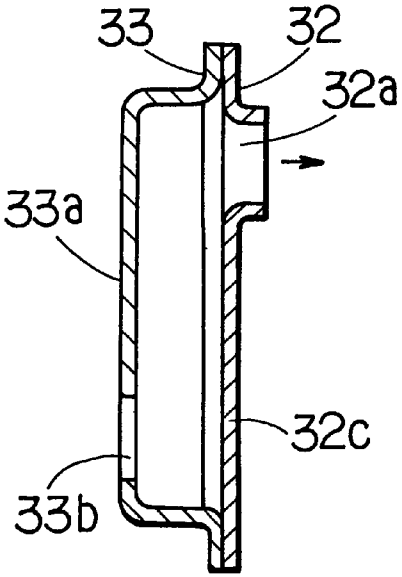
FIG. 12B is a cross-sectional view taken along line XIIB—XIIB in FIG. 12A.
Figure 12A:
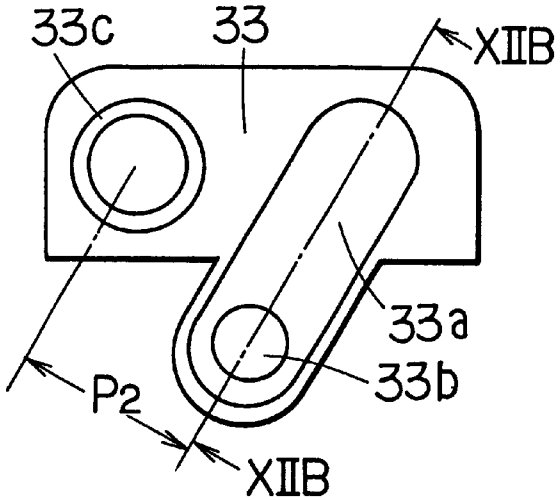
FIG. 12A is a front view showing the pipe joint portion of the evaporator according to the first embodiment.

As shown in FIG. 12C, the intermediate plate member 32 has an inlet-side opening 32*a* communicating with the inlet 6, an outlet-side opening 32*b* communicating with the outlet 7 and a protruding portion 32*c* protruding from a position adjacent the inlet-side opening 32*a* obliquely. The intermediate plate member 32 is made of an aluminum bare plate (A3000) on which the brazing material is not clad.

The joint cover 33 is made of an one-side clad aluminum plate clad with brazing material on one side surface thereof. The joint cover 33 is connected to the intermediate plate member 32 so that the surface clad with brazing material of joint cover 33 faces the intermediate plate member 32. The joint cover 33 has a passage forming portion 33*a*, a connection opening 33*b* formed at an end of the passage forming portion 33*a*, and a cylindrical portion 33*c*. The passage forming portion 33*a* is formed into a semi-cylindrical shape, and covers the intermediate plate member 32 from the inlet-side opening 32*a* to a protruding end portion of the protruding portion 32*c*. The cylindrical portion 33*c* is formed to protrude from a surface of the joint cover 33, and communicates with the outlet-side opening 32*b* of the intermediate plate member 32. The connection opening 33*b* of the joint cover 33 is connected to an outlet of the expansion valve, and the cylindrical portion 33*c* thereof is connected to an inlet of a gas refrigerant temperature detecting portion of the expansion valve.

The pipe joint portion is formed by integrally brazing the lid portion 31, the intermediate plate member 32 and the joint cover 33. Accordingly, referring to FIGS. 11, 12A, even when a pipe pitch P2 between an inlet and an outlet of the expansion valve is smaller than a pipe pitch P1 between the inlet 6 and the outlet 7, difference therebetween can be absorbed by the pipe joint portion.

Figure 13A:
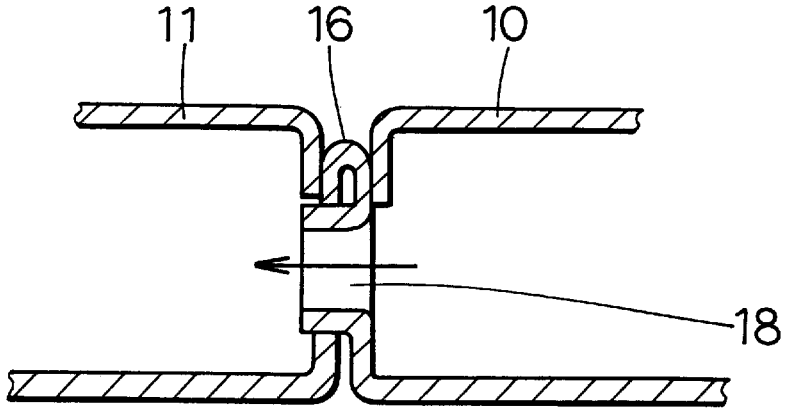
FIGS. 13A–13C are cross-sectional views showing bypass holes of the evaporator according to the first embodiment.
Figure 13B:
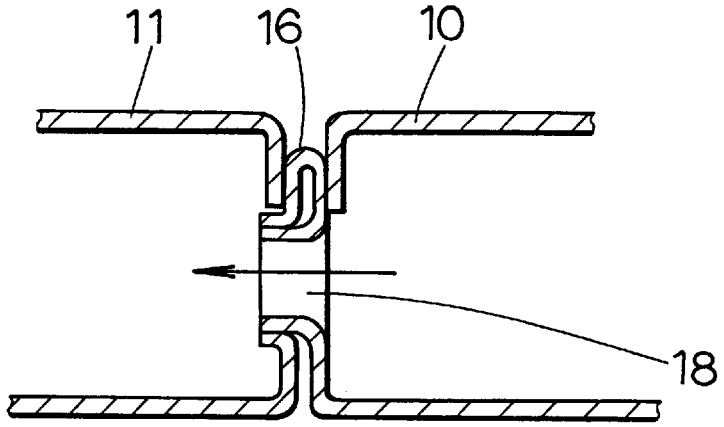
Figure 13C:
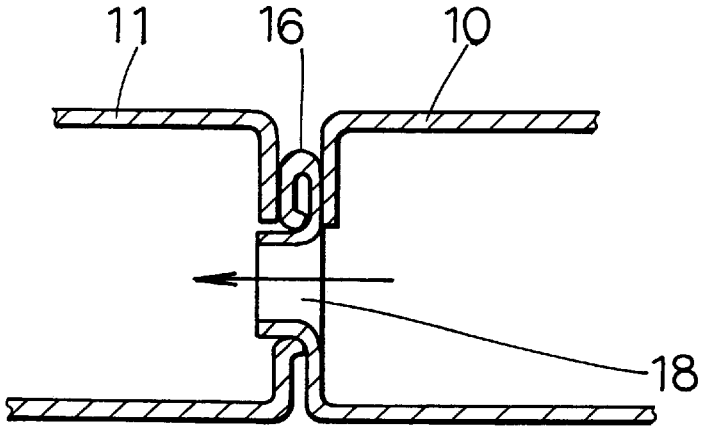

FIGS. 13A–13C show three examples of the bypass hole 18. In FIGS. 13A–13C, the bypass hole 18 is formed in the partition wall 16 (i.e., a center folded portion) between the tank portions 10, 11 to have a projecting portion along its circumference.

Figure 14A:
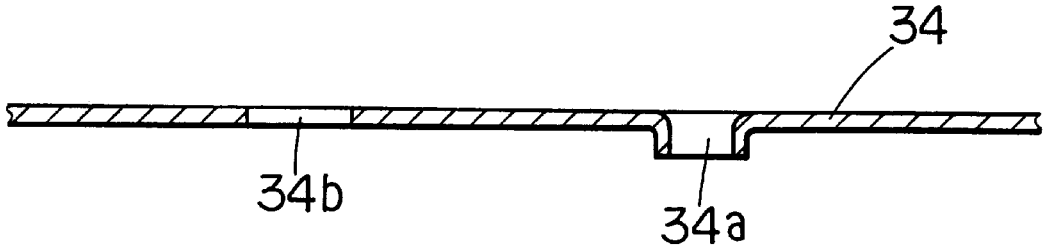
FIGS. 14A–14D are cross-sectional views showing a method for forming the bypass hole of the evaporator according to the first embodiment.
Figure 14B:
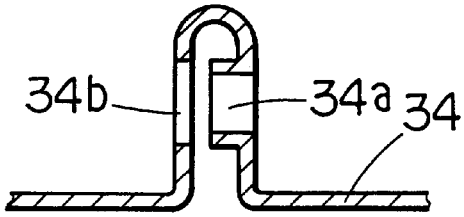
Figure 14C:
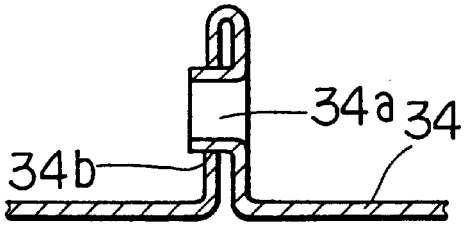
Figure 14D:
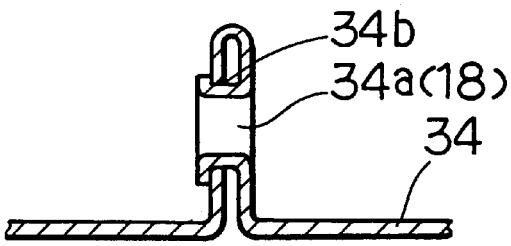

A method of forming the bypass hole 18 will be described with reference to FIGS. 14A–14D. First, as shown in FIG. 14A, a flue hole 34*a* with a projecting portion and a stamped hole 34*b* without a projecting portion are formed by pressing in an aluminum thin plate 34 forming the tank portions 8, 10, 11 and 13 (hereinafter the aluminum thin plate 34 is referred to as tank thin plate 34). The stamped hole 34*b* has a suitable diameter so that the projecting portion of the flue hole 34*a* can be inserted into the stamped hole 34*b*. Next, as shown in FIG. 14B, the tank thin plate 34 is bent to have a U-shape so that the flue hole 34*a* faces the stamped hole 34*b*. Then, as shown in FIG. 14C, the projecting portion of flue hole 34*a* is inserted into the stamped hole 34*b*. Further, as shown in FIG. 14D, an end portion of the projecting portion is bent toward an outer circumferential side for clamping. As a result, the projecting portion of the flue hole 34*a* is restricted from releasing from the stamped hole 34*b*, and the bypass hole 18 is formed.

According to the first embodiment of the present invention, the tank portions 8–13 and the tubes 2–5 are formed separately, and then integrally connected with each other. Therefore, the thickness of the tank portions 8–13 can be increased so that the tank portions 8–13 are reinforced, while the thickness of the tubes 2–5 is sufficiently decreased so that minuteness between the tubes 2–5 and the corrugated fins 19 is improved. As a result, the evaporator 1 becomes compact and has a sufficient cooling performance.

Further, the upper tank portions 8, 10, 11, 13 are formed by bending a single aluminum thin plate, and the lower tank portions 9, 12 are formed by bending a single aluminum thin plate, as shown in FIGS. 2, 14A–14D. Therefore, brazing material does not need to be applied on an outer surface of the aluminum thin plate for forming the tank portions 8–13, thereby improving anticorrosion performance of the tank portions 8–13.

Similarly, brazing material also does not need to be applied on an outer surface of the tubes 2–5, thereby improving anticorrosion performance of the tubes 2–5. Further, since no brazing material is applied on the outer surface of the tubes 2–5, a surface treated layer of the tubes 2–5 is efficiently formed. As a result, water-draining performance on the evaporator 1 is improved, thereby restricting the evaporator 1 from generating unpleasant smell.

Further, the corrugated fins 19 are not applied with brazing material, either. Therefore, a surface treated layer of the corrugated fins 19 is also efficiently formed. As a result, water-draining performance on the evaporator 1 is improved, thereby restricting the evaporator 1 from generating unpleasant smell.

A second preferred embodiment of the present invention will be described with reference to FIGS. 15, 16. In this and following embodiments, components which are similar to those in the first embodiment are indicated with the same reference numerals, and the explanation thereof is omitted.

Figure 15:
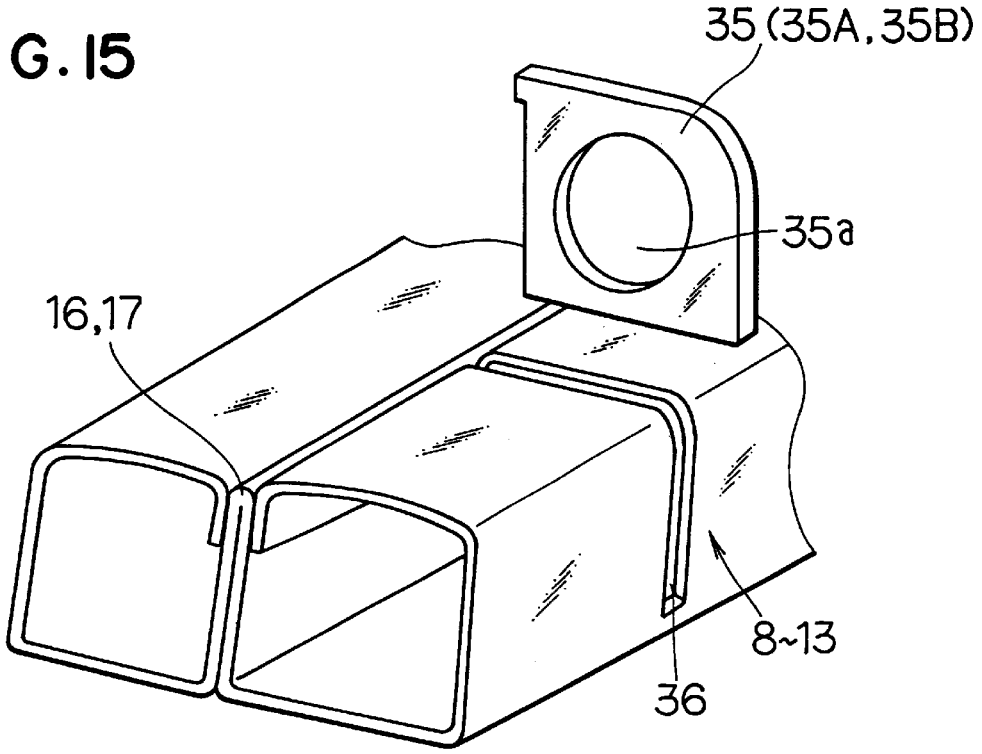
FIG. 15 is a disassemble perspective view showing a partition wall having a throttle hole and tank portions of an evaporator according to a second preferred embodiment of the present invention.

In the second embodiment, as shown in FIG. 15, a partition plate 35 having a throttle hole 35*a* is inserted into a slit groove 36 formed at an appropriate position in the tank portions 8–13 so that distribution uniformity of refrigerant into the tubes 2–5 is improved. The partition plate 35 is made of the same material as that of the partition plates 14, 15 in the first embodiment.

Figure 16:
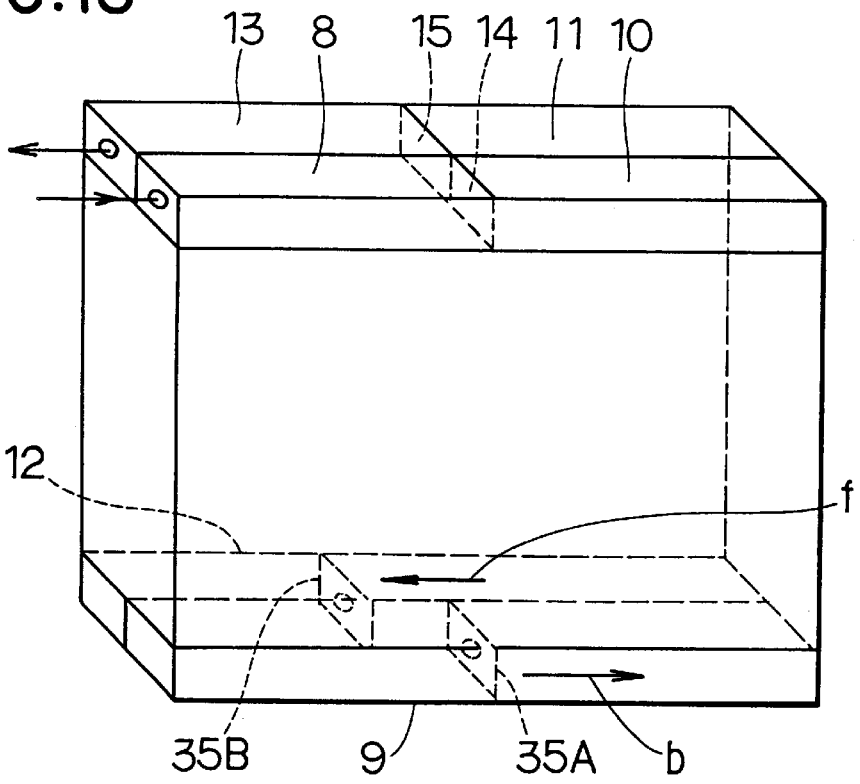
FIG. 16 is a schematic perspective view showing attachment positions of each partition wall having the throttle hole in the evaporator according to the second embodiment.

FIG. 16 shows an example of mounting position of the partition plate 35 including first and second partition plates 35A, 35B in the evaporator 1. As shown in FIG. 16, the partition plate 35A is disposed in the lower inlet-side tank portion 9 between the tubes 2 and 3. In the above-described first embodiment, as shown in FIG. 1, an inlet through which refrigerant is introduced into the tubes 3 and an outlet through which refrigerant is discharged from the tubes 5 are arranged in a center part of the evaporator 1 in the width direction in FIG. 1. Therefore, when refrigerant flows through the lower inlet-side tank portion 9 as shown by arrow "b", refrigerant tends to flow through the tubes 3, 5 disposed around the center part of the evaporator 1 in the width direction to take a shortcut.

According to the second embodiment of the present invention, a flowing amount of refrigerant flowing through the lower inlet-side tank portion 9 is throttled by the throttle hole 35*a* of the first partition plate 35A. Therefore, a velocity of refrigerant passing through the throttle hole 35*a* is increased, thereby enabling refrigerant to reach an innermost part (i.e., right end part in FIG. 16) of the tank portion 9. As a result, refrigerant sufficiently flows through not only the tubes 3 disposed at the center part of the evaporator 1 but also the tubes 3 at the right end of the evaporator 1, thereby further improving distribution uniformity of refrigerant into the tubes 3, 5.

Further, in the second embodiment of the present invention, as shown in FIG. 16, the second partition plate 35B is disposed in the lower outlet-side tank portion 12 at a center part of the tubes 4 in the width direction in FIG. 1. In the above-described first embodiment, as shown in FIG. 1, an inlet through which refrigerant is introduced into the tubes 4 is located at a center part of the evaporator 1 in the width direction, and an outlet through which refrigerant is discharged from the tubes 4 is located at a left end part of the evaporator 1 in the width direction in FIG. 1. Therefore, when refrigerant flows through the lower outlet-side tank portion 12 as shown by arrow "f", refrigerant tends to flow through the tubes 4 disposed at the left end part of the evaporator 1.

According to the second embodiment of the present invention, a flowing amount of refrigerant flowing through the lower outlet-side tank portion 12 is throttled by the throttle hole 35*a* of the second partition plate 35B, thereby restricting refrigerant from intensively flowing through the tubes 4 disposed at the left end part of the evaporator 1. As a result, refrigerant sufficiently flows through not only the tubes 4 disposed at the left end part of the evaporator 1 but also the tubes 4 at the center part of the evaporator 1, thereby improving distribution uniformity of refrigerant flowing into the tubes 4.

Figure 18:
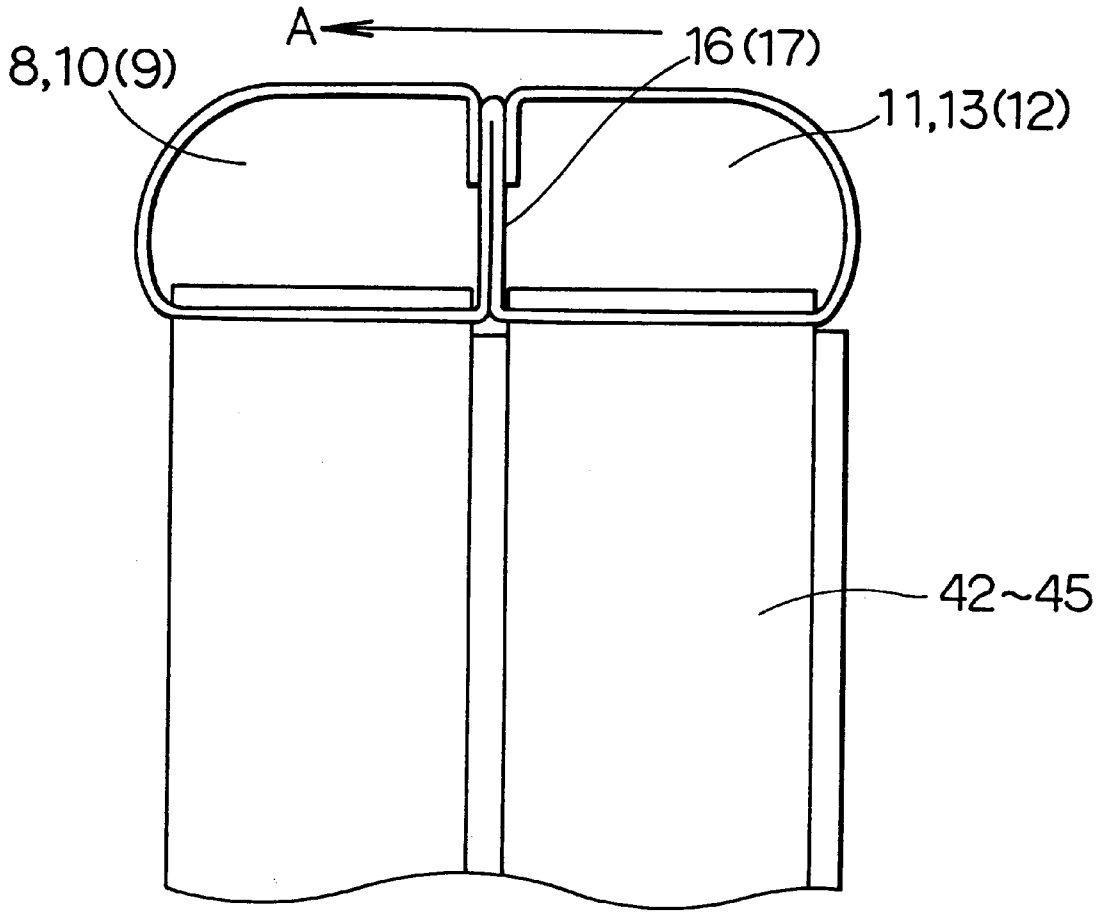
FIG. 18 is a schematic view showing a connection structure between tank portions and a tube of the evaporator according to the third embodiment.
Figure 19:
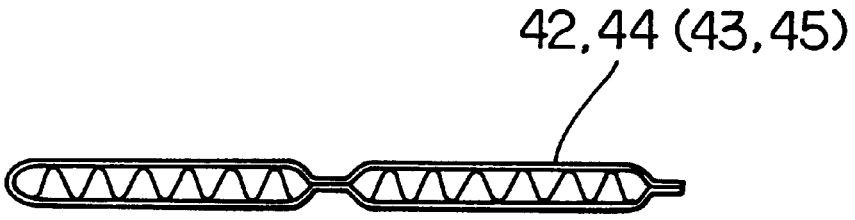
FIG. 19 is a cross-sectional view showing the tube of the evaporator according to the third embodiment.
Figure 20:
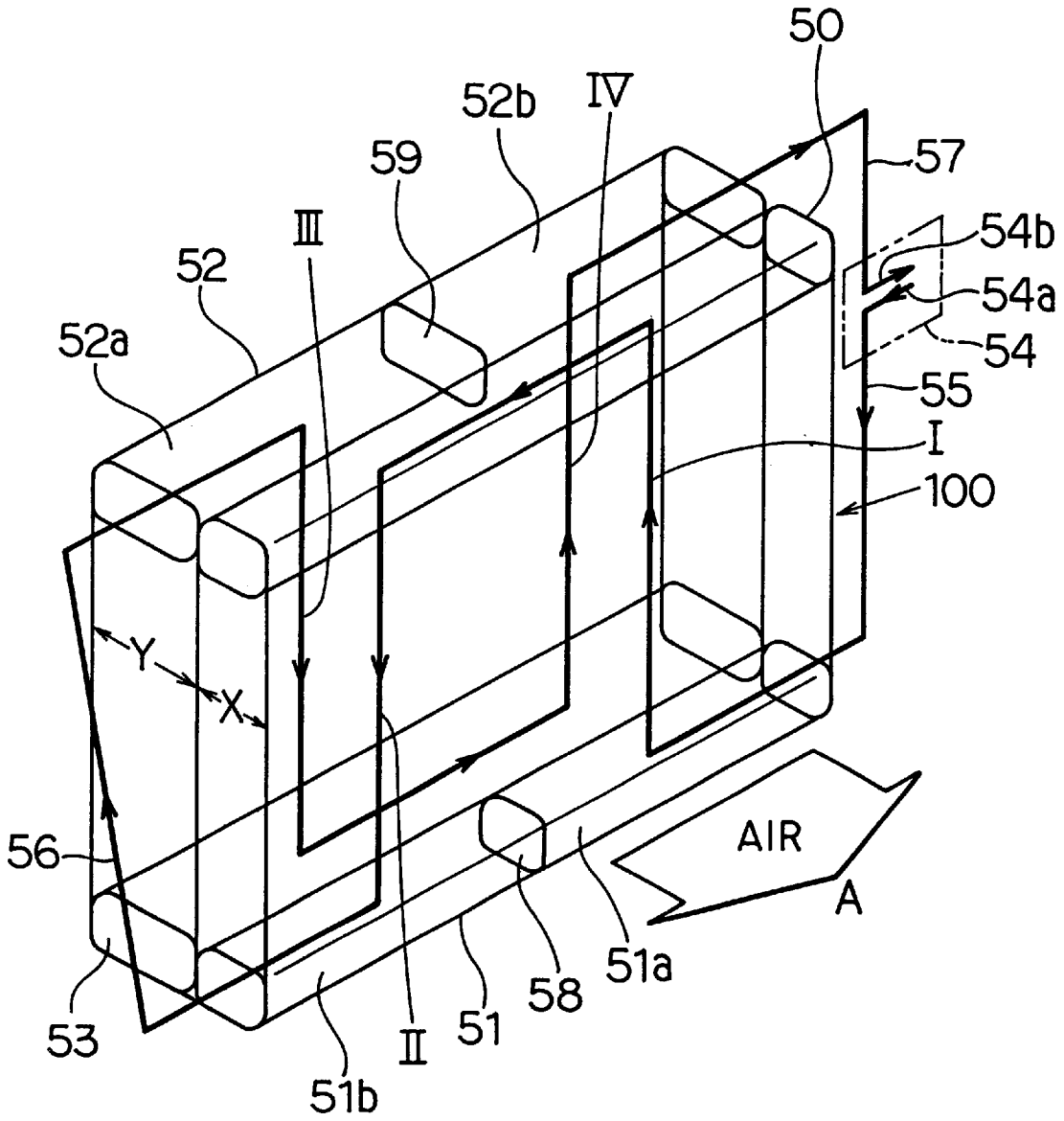
FIG. 20 PRIOR ART
FIG. 20 is a schematic perspective view showing a refrigerant passage of a conventional evaporator.

A third preferred embodiment of the present invention will be described with reference to FIGS. 17–19.

Figure 17:
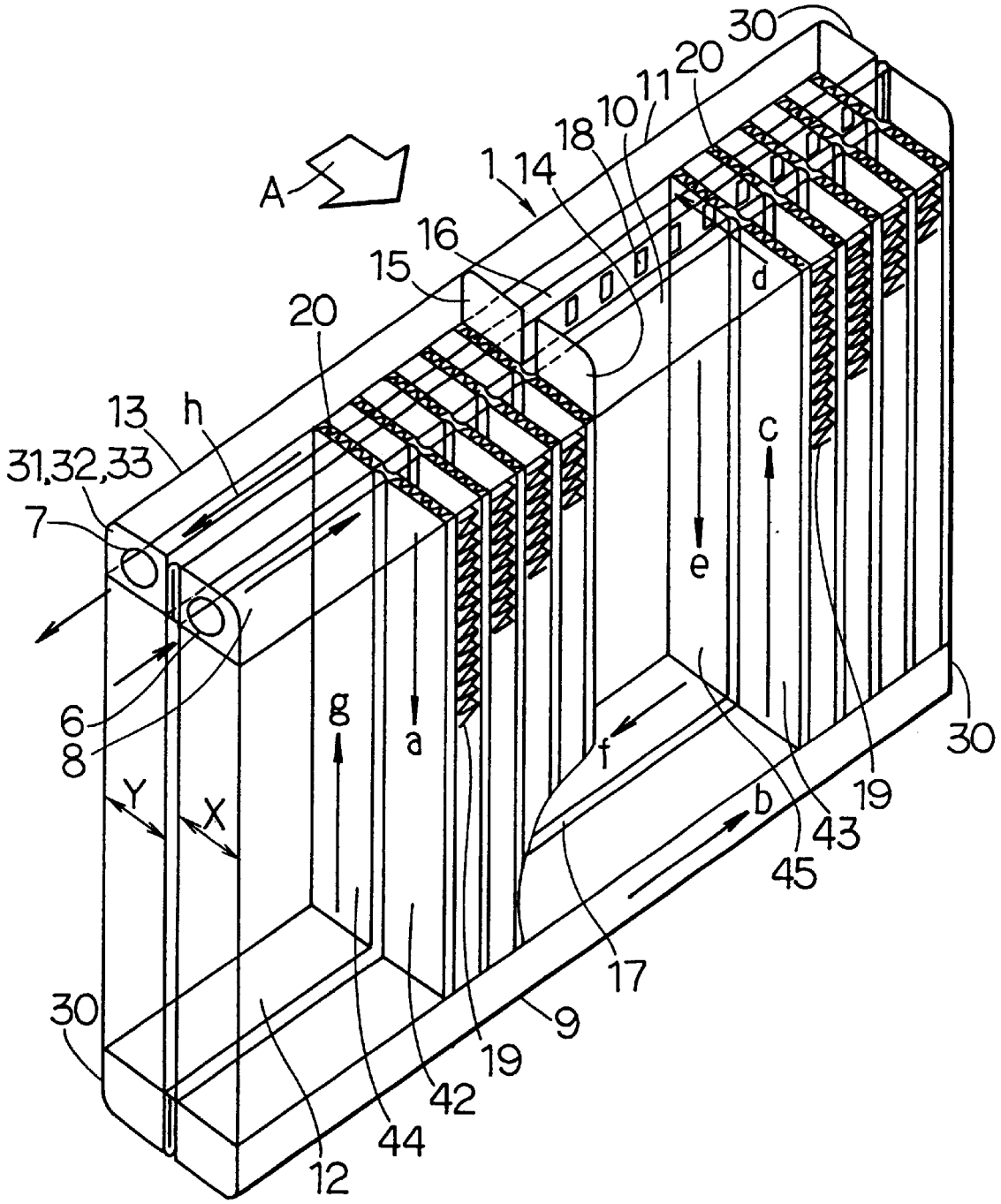
FIG. 17 is a schematic perspective view showing an evaporator according to a third preferred embodiment of the present invention.

In the third embodiment of the present invention, as shown in FIG. 17, the evaporator 1 has tubes 42–45 arranged in parallel with each other in the width direction. As shown in FIG. 19, both upstream and downstream tubes in the tubes 42, 44 in the air flowing direction A are integrally formed by bending a single aluminum thin plate, and both upstream and downstream tubes in the tubes 43, 45 in the air flowing direction A are also integrally formed by bending a single aluminum thin plate.

According to the third embodiment, both tubes arranged at upstream and downstream sides in the air flowing direction can be integrally formed, and can be integrally inserted into the upper tank portions 8, 10, 11, 13 or can be integrally into the lower tank portions 9, 12 Therefore, assembly efficiency of the evaporator 1 is further improved.

Although the present invention has been fully described in connection with preferred embodiments thereof with reference to the accompanying drawings, it is to be noted that various changes and modifications will become apparent to those skilled in the art.

Figure 21:
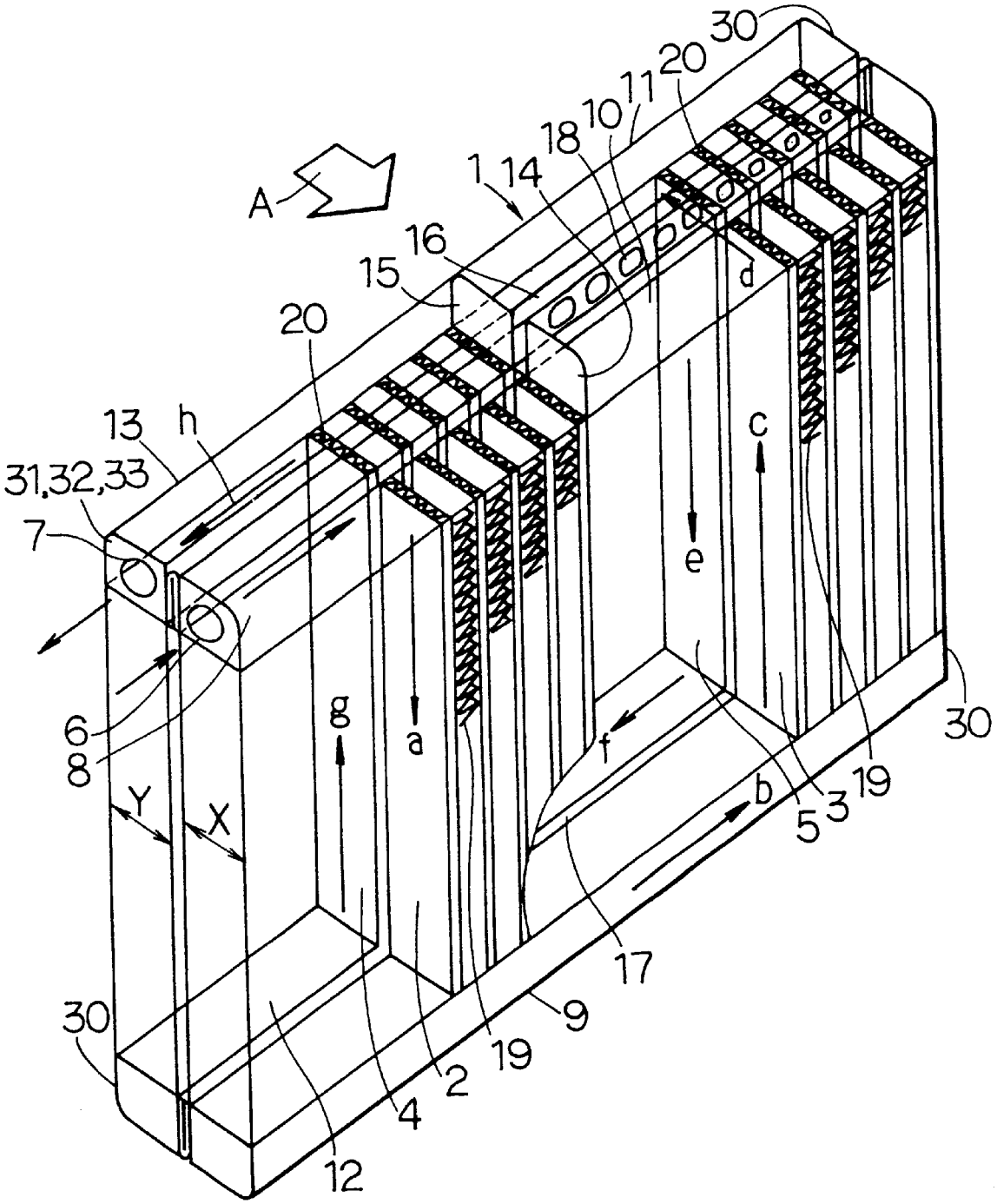
FIG. 21 is a schematic perspective view showing an evaporator according to another embodiment of the present invention.

For example, in the above-described first embodiment of the present invention, each of the bypass holes 18 is formed into a rectangle shape to have a uniform opening area. However, since refrigerant tends to flow into an innermost part (i.e., right end part in FIG. 1) of the tank portion 9 due to inertia, the opening areas of the bypass holes 18 may be decreased toward the right side as shown in FIG. 21. As a result, distribution uniformity of refrigerant following from the tank portion 11 to each of the tubes 5 is further improved. Furthermore, each of the bypass holes 18 may be formed into a round shape or the other shape.

In the above-described embodiments, the present invention is typically applied to a refrigerant evaporator for a refrigerant cycle. However, the present invention may be applied to a heat exchanger in which a first fluid flowing inside the heat exchanger is heat-exchanged with a second fluid flowing outside the heat exchanger.

In the above-described embodiments, the tubes 2–5 are arranged in two rows in the air flowing direction A, and the tank portions 8–13 are also arranged in two rows in the air flowing direction A to correspond to the tubes 2–5. However, the tubes 2–5 may be arranged in plural rows more than two rows in the air flowing direction A, and the tank portions 8–13 may be arranged to correspond to tubes 2–5 arranged in the plural rows.

Such changes and modifications are to be understood as being within the scope of the present invention as defined by the appended claims.

What is claimed is:

1. An evaporator for performing heat exchange between refrigerant flowing therethrough and external fluid flowing outside said evaporator, said evaporator comprising:

a plurality of tubes through which refrigerant flows, said tubes being arranged in parallel with each other in a width direction perpendicular to a flow direction of the external fluid, and being arranged in plural rows in the flow direction of the external fluid;

a tank for distributing refrigerant into said tubes and for collecting refrigerant from said tubes, said tank being disposed at both ends of each tube; and a partition wall member for defining said tank into plural tank portions extending in the width direction, said tank portions being arranged to correspond to said tubes in the plural rows in the flow direction of the external fluid, wherein:

said tank has an inlet through which refrigerant is introduced, and an outlet through which refrigerant having passed through said tank portions and said tubes is discharged;

said partition wall has a plurality of holes through which tank portions adjacent to each other in the flow direction of the external fluid communicate with each other;

said plurality of holes are arranged in said width direction; and opening areas of said holes are gradually decreased toward a side away from said inlet in said width direction.

2. The evaporator according to claim 1, wherein said holes have different opening areas different from each other.

3. The evaporator according claim 1, wherein said inlet and said outlet are respectively provided in said tank portions at the same end side in the width direction.

4. The evaporator according to claim 1, wherein said tubes and said tank portions are integrally connected to each other after being separately formed.

5. The evaporator according to claim 1, wherein:

said tank portions and said partition wall having said holes are comprised of a first single metal plate; and said holes are provided in said first metal plate.

6. The evaporator according to claim 5, wherein each of said tubes is comprised of a second single metal plate.

7. The evaporator according to claim 1, wherein each of said holes is provided in said partition wall between adjacent tubes in the width direction.

8. An evaporator for performing heat exchange between refrigerant flowing therethrough and external fluid flowing outside said evaporator, said evaporator comprising:

a plurality of upstream tubes through which refrigerant flows in a longitudinal direction of each upstream tube, said upstream tubes being arranged in parallel with each other in a width direction perpendicular to both of a flow direction of the external fluid and the longitudinal direction of said upstream tubes, a plurality of downstream tubes through which refrigerant flows in the longitudinal direction, said downstream tubes being arranged in parallel with each other in the width direction at a downstream side of said upstream tubes in the flow direction of the external fluid;

a tank for distributing refrigerant into said upstream and downstream tubes and for collecting refrigerant from said upstream and downstream tubes, said tank having an upstream tank portion connecting to each one side end of said upstream tubes in the longitudinal direction, and a downstream tank portion connecting to each one side end of said downstream tubes in the longitudinal direction;

a first partition member extending in the width direction, said first partition member being disposed between said upstream and downstream tank portion to define said upstream and downstream tank portions; and a second partition member for partitioning a passage of said upstream tank portion into first and second upstream tank passages in the width direction, and for partitioning a passage of said downstream tank portion into first and second downstream tank passages in the width direction, wherein:

said downstream tank portion has an inlet for introducing refrigerant into said first downstream tank passage communicating with said inlet, at an end side in the width direction;

said upstream tank portion has an outlet for discharging refrigerant from said first upstream tank passage communicating with said outlet, at the same side of said inlet in the width direction;

said first partition member has a plurality of holes between said second upstream tank passage and said second downstream tank passage so that said second upstream tank passage communicates with said second downstream tank passage through said bypass passage means;

said holes are arranged in a row in the width direction between the second upstream tank passage and the second downstream tank passage; and opening areas of said holes are decreased in a flowing direction of refrigerant flowing from said inlet to said first downstream passage in the width direction.

9. The evaporator according to claim 8, wherein said second partition member is disposed at each approximate center of said upstream and downstream tank portions in the width direction.

10. The evaporator according to claim 8, wherein said holes have different opening areas different from each other.

11. The evaporator according to claim 8, wherein:

said upstream and downstream tank portions and said first partition member are comprised of a first single metal plate; and said holes are provided in said first single metal plate.

12. The evaporator according to claim 11, wherein each of said tubes is comprised of a second single metal plate.

13. The evaporator according to claim 8, wherein each of said holes is provided in said first partition member between adjacent upstream tubes in the width direction.

* * * * *